US005110193A

United States Patent [19]

McClenning

[11] Patent Number: 5,110,193

[45] Date of Patent: May 5, 1992

[54] PORTABLE TRAVEL PANTRY

[76] Inventor: Roy McClenning, P.O. Box 396, Tonica, Ill. 61370

[21] Appl. No.: 666,623

[22] Filed: Mar. 8, 1991

[51] Int. Cl.[5] ..... A47B 88/00

[52] U.S. Cl. ..... 312/282; 312/237; 312/241; 312/244

[58] Field of Search ..... 312/240, 241, 244, 280, 312/282, 237

[56] References Cited

U.S. PATENT DOCUMENTS

| | | | |
|---|---|---|---|
| 2,453,129 | 11/1948 | Hinton | 312/290 |
| 2,662,989 | 12/1953 | Thatcher | 312/290 X |
| 2,667,392 | 1/1954 | Sexton | 312/244 X |
| 2,672,921 | 3/1954 | Herrick | 312/241 X |
| 3,854,624 | 12/1974 | Canci | 312/244 X |

*Primary Examiner*—Joseph Falk

*Attorney, Agent, or Firm*—Hill, Van Santen, Steadman & Simpson

[57] ABSTRACT

A portable travel pantry has a rectangular main module for carrying food items and items relating to serving of food. The main module has separate compartments for conveniently storing eating utensils, food boxes, canned goods, and plates used for serving food. The main module has a swingable front wall and a swingable top wall, each of which is swingable between a transport configuration and a serving configuration. A catch-all module for receiving relatively bulky items may be selectively attached and detached from the main module. The portable travel pantry provides for an arrangement and segregation of the various food items and items relating to serving of the food, and the swingable front wall together with the swingable top wall provide for convenient access to the inside of the travel pantry and also additional surfaces for preparation of the meal. The detachable catch-all can be conveniently detached and placed alongside the main module when serving and preparing the meal.

14 Claims, 3 Drawing Sheets

PORTABLE TRAVEL PANTRY

BACKGROUND OF THE INVENTION

The present invention relates to the transport of food and related items for eating and serving a meal at a location which is away from home.

When travelling away from home such as in a recreational vehicle or in the family automobile, frequently it is desirable to bring food for eating either during travelling such as in the recreational vehicle, or at an outside destination such as a lake, picnic grove, the beach, etc.

When transporting the food, various types of picnic basket arrangements or coolers have been utilized in which the food items, plates, utensils, etc. are transported inside the cooler or in the picnic basket or bag in a loose, jumbled manner.

Upon arriving at the destination and then preparing the meal, it is necessary to unpack each of the necessary food items and related utensils, plates, and drinking cups. However, since such items have been mixed or jumbled together in the container used for carrying them, it is very inconvenient and time consuming to set up and arrange the various items in order to serve the meal. Furthermore, after completion of the meal and when returning home, it is then necessary to repack various items. This results in the various items being mixed together in jumbled fashion in the carrying container, thus requiring that they again be separated and re-arranged upon arriving back home.

A further disadvantage of eating at a remote location as described above is that the various items necessary for the meal are arbitrarily scattered on the location where the meal is being served, such as on a picnic table, thus increasing the difficulty of serving the meal.

SUMMARY OF THE INVENTION

It is an object of the present invention to simplify the preparation of a meal at a remote location away from the home, such as at a picnic grove, at the beach, in a recreational vehicle, when camping, etc.

It is a further object of the invention to organize food items and items necessary for serving the food in a logical and convenient manner so as to enhance the ability of one serving a meal at an outside location to both set up and serve the meal and to clean up afterwards with a minimum of difficulty.

According to the invention, a portable travel pantry is provided having a main module for carrying food items and items relating to serving of food. The main module has a first compartment for separately storing utensils, and additional separate compartments for storing boxes, canned goods, and serving plates. The main module has a swingable front wall and a swingable top wall, the top wall and front wall being swingable between a transport configuration and a serving configuration. A catch-all module is provided for receiving relatively bulky items. Means is provided for selectively and detachably connecting the catch-all module to the main module such that when the handle on the main module is employed to lift the main module, the catch-all module is also carried along with the main module. Also, when the catch-all module is detached, handles are provided for carrying that module separately.

DESCRIPTION OF THE PREFERRED EMBODIMENTS

Figure 1:
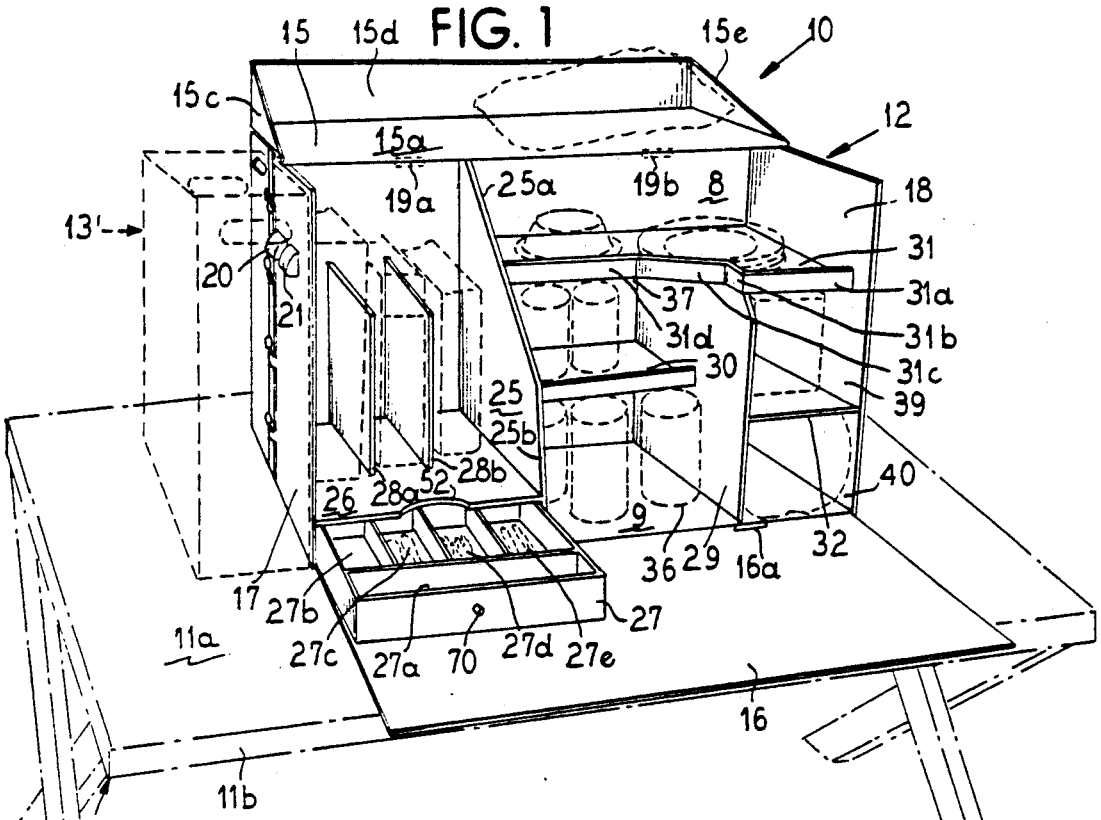
FIG. 1 is a perspective view of a portable travel pantry according to the invention in a serving configuration.

The portable travel pantry according to the invention is generally shown at 10 in FIG. 1 in an open or serving configuration. Typically, the pantry 10 will be placed on a serving table such as a picnic table 11. The pantry 10 comprises a main module 12 and a separate detachable subsidiary or catch-all module 13 detachably hooked at the back of the main module 12.

Figure 2:
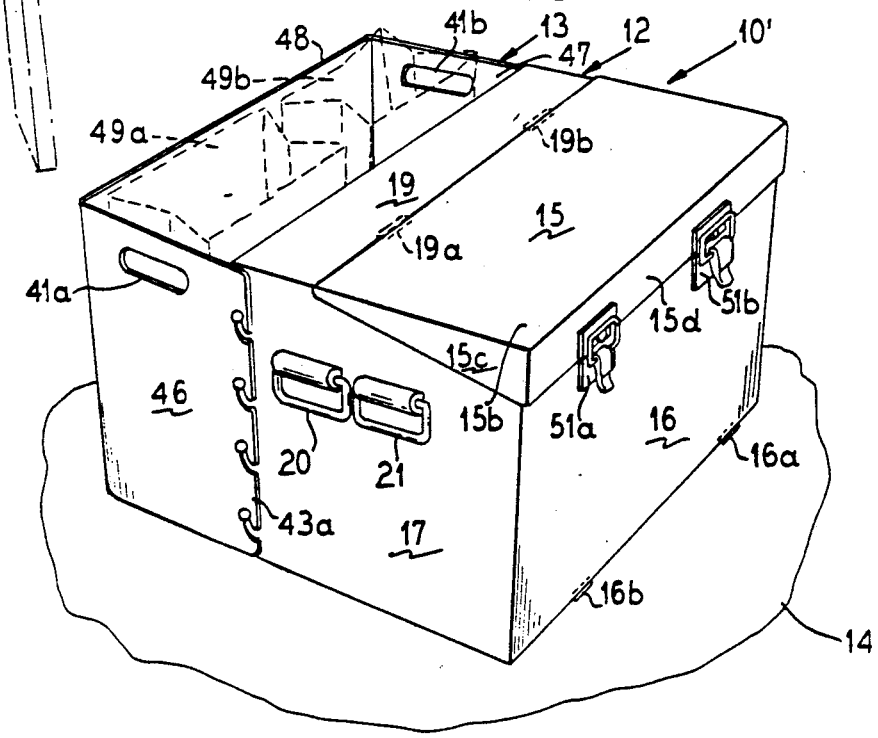
FIG. 2 is a perspective view of the portable travel pantry of FIG. 1 in a transport configuration.
Figure 4:
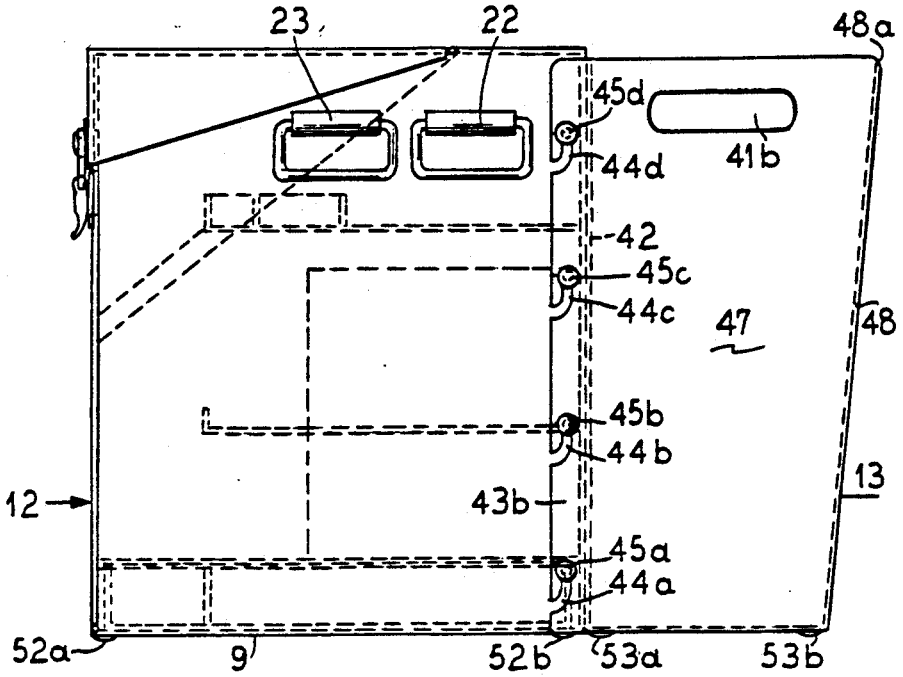
FIG. 4 is a side view of the portable travel pantry shown in FIG. 2.

FIG. 2 shows the portable travel pantry in a transport or closed configuration 10' resting on ground 14, and ready to be picked up by use of transport handles 20, 21 at the left side and 22, 23 at the right side (FIG. 4). If the subsidiary or catch-all module 13 is attached to the main module 12, then handles 20 and 22, which are positioned closer to the back of the main module, are employed so that the center of gravity will lie approximately between the handles 20 and 22 and thus the unit can be conveniently carried without tipping forward or backward. Alternatively, if the catch-all module 13 is not attached, then the more forwardly located handles 21, 23 which are closer to the front of the pantry unit are employed since then the center of gravity is also close to the front and the unit will then not tip when being carried.

The pantry main module and catch-all module shown in FIGS. 1 and 2 are preferably constructed of a lightweight plastic such as may be formed, for example, by an injection molding process or the like.

The travel pantry has a swingable top cover 15 shown in the closed condition in FIG. 2 and in the open condition in FIG. 1. In the open condition, the undersurface 15*a* of the cover 15 may serve as a top shelf for receiving food items during preparation for serving. The swingable top cover 15 is attached by extruded hinge members 19*a*, 19*b* or other types of hinges to a top back surface portion 19. When the top cover 15 is folded back as shown in FIG. 1, then its top surface 15*b* will rest on the top back surface portion 19 and be supported thereby.

The swingable top cover 15 preferably has a first triangular shaped side wall 15*c*, a front lip portion 15*d* and a right triangular side portion 15*e*.

A swingable front cover 16 has its upper edge overlapped by the swingable top cover front skirt 15*d* when in the transport configuration as shown in FIG. 2. In the serving configuration of FIG. 1, the front swingable wall 16 rests on a top surface 11*a* of the picnic table 11 and can be used then as a clean serving platform. If the pantry is set near the edge 11*b* of the picnic table 11, then the front edge portion of the swingable front wall 16 may overlap beyond the edge of the table and provide a convenient extended serving surface.

The front swingable wall 16 is joined by hinge members 16*a, b* to a main floor portion 9 of the main module 12. The hinges may be extruded hinges or other forms of hinge arrangements.

Figure 3:
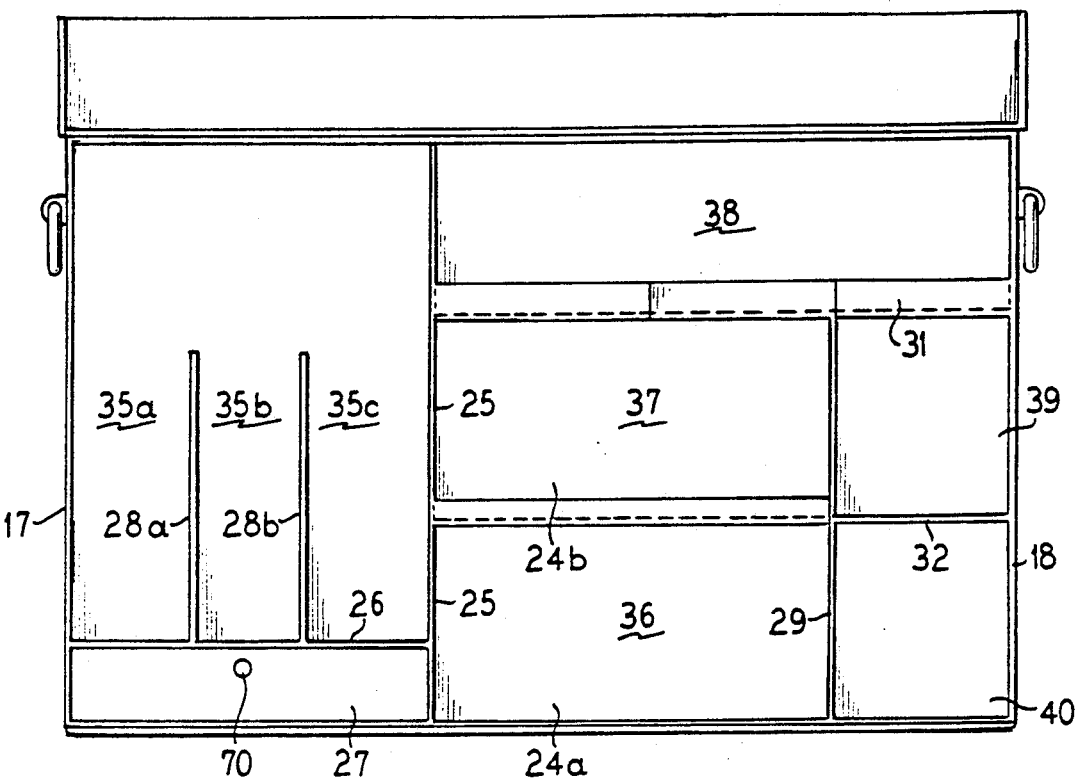
FIG. 3 is a front view of the travel pantry of FIG. 1 in a serving configuration, but which, for clarity, is shown empty.

Referring to FIGS. 1, 2, and 3, the main module 12 has side walls 17 and 18 extending upwardly from the main floor portion 9. The top back surface portion 19 joins the walls 17 and 18 and supports them at the top.

The interior of the portable travel pantry has a vertical dividing or partitioning wall 25 with an angled surface 25*a* extending from a back wall 8 of the main module to a front thereof where the wall terminates with a vertical edge 25*b*. As viewed from the front, to the left side of the partition or divider 25, a slidable pull-out utensil drawer 27 is provided. The utensil tray or drawer 27 has a front compartment 27*a* and four rearwardly extending back compartments 27*b*, 27*c*, 27*d*, and 27*e* for segregating various types of eating utensils and knives used for preparation of the meal. A compartment for receiving the drawer 27 is defined by a shelf 26 between the partition 25 and the side wall 17.

The region between the partition 25, the side wall 17, and back wall 8 defines a space for receiving relatively tall add narrow food boxes such as cereal, cracker, and cookie boxes. Individual partitions 28*a* and 28*b* for segregating the food boxes are provided extending upwardly from the shelf 26 and are secured to the back wall 8, such as shown most clearly in FIGS. 1 and 5.

Figure 5:
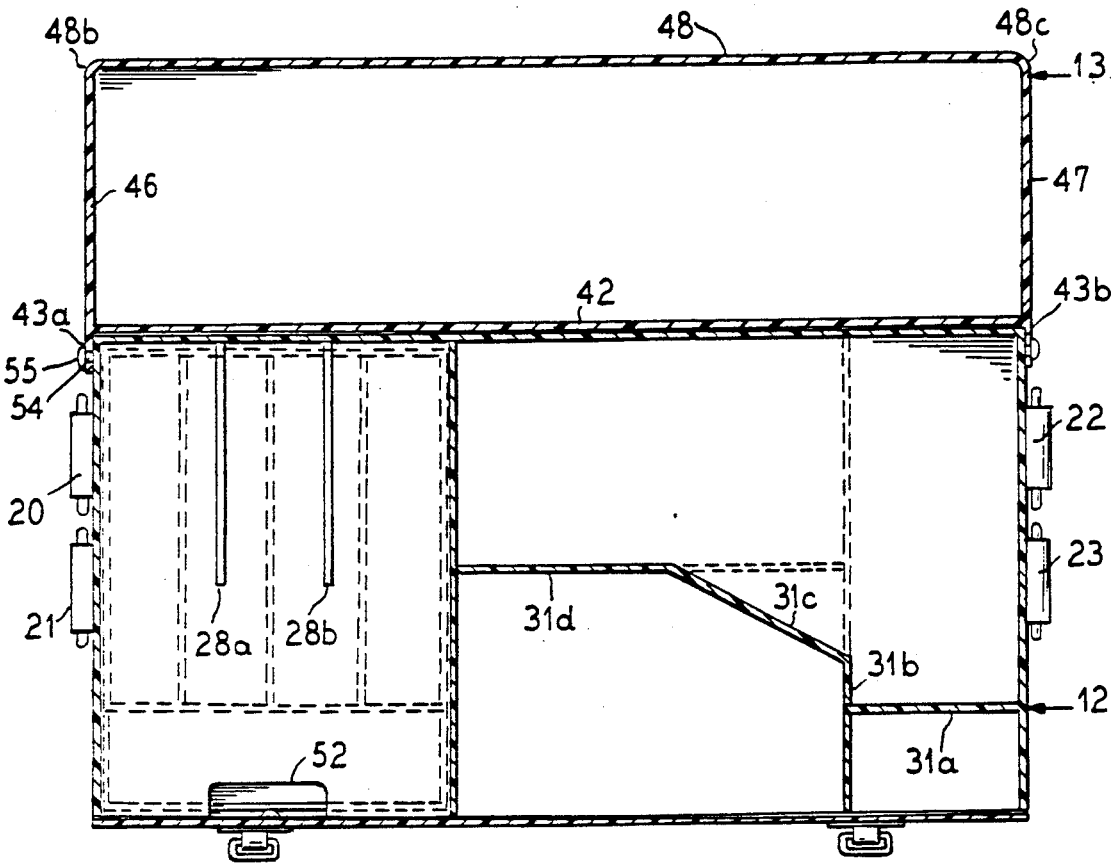
FIG. 5 is a top view taken along section line V—V of FIG. 3.

To provide an access grip for pulling out the utensil drawer 27, a cut-out 52 is provided in the front portion of the shelf 26, as shown most clearly in FIGS. 1 and 5. Also, a knob 70 may be optionally provided on the drawer.

To the right side of the partition 25 in the main module 12 are provided compartments for receiving canned goods, serving wares such as paper or plastic cups, bowls, and plates, together with additional compartments for relatively low profile square or rectangular items such as bread loaves.

More specifically, between partition 25 and right side wall 18, an upper contoured shelf 31 is provided for receiving serving dishes such as plastic or paper cups, plates, and bowls. The shelf 31 has a front lip defined by segments 31*a*, 31*b*, 31*c*, and 31*d*.

The upper shelf 31 is supported by a vertical partition 29 substantially intermediate between the partition 25 and right side wall 18, and extends from the floor 9 up to the bottom surface of the shelf 31.

Between the second partition 29 and the first partition 25, two compartments are defined for canned goods. A lower canned goods compartment 36 is formed beneath a shelf 30 and the floor 9. The shelf 30 is supported between the second partition 29 and the first partition 25. Between the shelf 30 and the underside of the contoured shelf 31 a second upper canned goods compartment 37 is defined.

Between the second partition 29 and the right side wall 18, and beneath the shelf 31, a first lower compartment 40 and a second upper compartment 39 for receiving substantially rectangular boxes or other items having a relatively low profile such as wrapped bread loaves are provided. These two compartments are defined by a central shelf 32 supported between the second partition 29 and right side wall 18 at a point intermediate between the lower surface of the shelf 31 and the floor 9.

Referring to FIG. 3, it can thus be seen that at the left side of partition 25, a utensil drawer 27 is provided together with relatively narrow and tall compartments 35*a*, 35*b*, and 35*c* for cereal or cracker boxes. To the right side of the first partition 25, the lower first canned goods compartment 36 and an upper canned goods compartment 37 are provided. Above the two canned goods compartments a region 38 is defined for receiving serving ware such as bowls, plates, cups, and the like. Beneath the serving ware shelf and to the right of the canned goods first and second regions or compartments are provided, namely the lower first and the upper second compartments 40 and 39, respectively for receiving relatively rectangular food items such as bread loaves or boxes having a relatively small height.

Referring now more particularly to FIGS. 2, 4, and 5, details concerning the subsidiary or catch-all module 13 will now be described in greater detail. The catch-all module 13 has carrying and removal handles 41*a*, 41*b* at the top of respective side walls 46 and 47. The catch-all module also has a back wall 48 and a front wall 42 so that a substantially rectangular four-sided enclosure is provided. Preferably the back wall 48 slants inwardly from top to bottom.

Thus, the catch-all module 13 forms a rectangular enclosure for receiving and transporting substantially more bulky items or other miscellaneous items such as might be placed in paper bags 49*a* and 49*b* as shown in FIG. 2.

The rectangular module 13 is retained in removable hook-like fashion at the back side of the main module 12 by use of overlapping side flanges 43*a* and 43*b* which are respective extensions of walls 46 and 47, as shown in FIGS. 2, 4, and 5. As shown in FIG. 4, each of these flanges 43*a* and 43*b* has a plurality of upwardly curved slots 44*a, b, c, d* having a substantially horizontal entrance portion and a substantially vertical engaging and retention portion in FIG. 4. Each of these slots receives respective protruding engagement posts 45*a, b, c, d* provided for each of the respective slots in each of the respective flanges 43*a* and 43*b* such as shown in FIG. 4. These engagement posts protrude outwardly from the outside surface of sidewalls 17 and 18 along the rear vertical edges thereof. Each post has a cylindrical portion 54 received within the slot and a head portion 55 as shown in FIG. 5.

With the detachable structure defined above, the subsidiary or catch-all module 13 can thus be lifted free from the back wall 8 of the main module 12 by use of handles 41*a*, 41*b* and can be set alongside the left or right side walls 17 or 18 of the main module 12 such as shown in dashed lines at 13' in FIG. 1 for convenient access when the main module 12 is in the serving configuration.

As shown in FIG. 4, rib-like protrusions 52*a* and 52*b* can be provided on the main module 12 along the respective front edge and back edge of the floor 9. Similarly, the catch-all module 13 can have rib-like protrusions 53*a* and 53*b*. The rib-like protrusions 52*a*, 52*b*, 53*a*, and 53*b* all further strengthen the respective main module 12 and catch-all module 13, and also serve as legs for the modules.

Preferably the main module 12 has a width in a range from 24 to 28 inches, a depth in a range from 11½ to 15½ inches, and a height in a range from 14 to 18 inches. The catch-all module preferably has a width range which is the same as the main module 12, that is from 24 to 28 inches, a depth at the bottom of from 5 inches to 9 inches, a depth at the top of from 6 inches to 10 inches, and a height which is the same as the main module, that is from 14 inches to 18 inches. A preferred ratio of the main module depth to the catch-all module depth (at the bottom) is in a range from 1.5 to 2.7.

Figure 6:
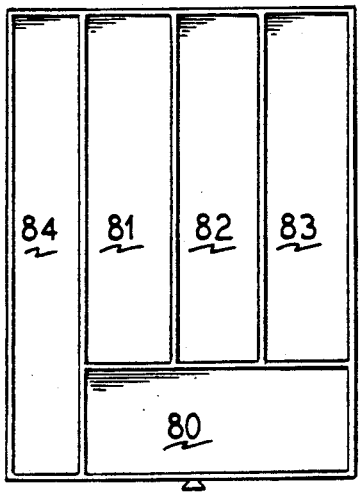
FIG. 6 is an alternate embodiment for a utensil drawer as employed in the invention.

Although the utensil drawer was described in relation to FIG. 1 as having a front compartment with four rearwardly extending compartments, alternatively, as shown in FIG. 6, if long sharp knives are to be stored, then the front compartment can be cut short such as shown at 80 such that three compartments 81, 82, 83 such as for knives, forks, and spoons are provided to the rear of the front compartment used for accessories, and a long rearwardly extending compartment 84 can be provided to the left of the front accessory compartment for long sharp knives.

The aforementioned slanting portion of the first divider 25 provides for easy access to the compartments to the left of the partition holding the tall narrow profile boxes, and to the first and second compartments 36 and 37 holding the canned goods.

At the top of the catch-all module side walls 46 and 47, adjacent the top of the back wall 48, the edge is rounded as shown in FIG. 4 at 48*a* for safety. Similarly, at the corner transitions 48*b* and 48*c* as shown in FIG. 5, between the back wall 48 and the respective side walls 47 and 46, the corners are also rounded for safety.

The back wall 48 of the catch-all module 13 is slanted as previously described. This slanting or tapering feature allows for ease of plastic molding in addition to facilitating removal of large bulky items such as grocery bags.

As shown in FIG. 2, the front lip portion 15*d* of the swingable cover 15 has latches 51*a* and 51*b* which engage with the swingable front wall 16 when the front wall 16 is overlapped by the lip portion 15*d* in the closed or transport configuration as shown in FIG. 2.

As an alternative for carrying food items, the universal or subsidiary catch-all module 13 is also suitable for carrying garbage such as after a meal has been completed, the garbage thus being segregated from the remaining food items stored in the main module.

Although various minor changes and modifications might be proposed by those skilled in the art, it will be understood that I wish to include within the claims of the patent warranted hereon all such changes and modifications as reasonably come within my contribution to the art.

I claim as my invention:

1. A portable travel pantry, comprising:

a rectangular main module means for carrying and for arranging and segregating food items and items related to serving of food;

said main module means having first compartment means for separately storing eating utensils, second compartment means for storing food boxes, third compartment means for storing canned goods, and fourth compartment means for storing plates used for serving food;

said main module means having a swingable front wall, a swingable top wall, and a back wall opposite the front wall, the top wall and front wall each being swingable between a transport configuration and a serving configuration;

a catch-all module means having a front wall and an open top for receiving relatively bulky food items at an inside thereof;

handle means at sides of the main module means for carrying the main module means; and means for selectively attaching and detaching the catch-all module means to the main module means such that said back wall of the main module means is parallel and directly adjacent to said front wall of the catch-all module means when the catch-all module means is attached to the main module means, and such that when the handle means on the main module means is employed to lift the main module means, the catch-all module means is also carried along with the main module means when it has been selectively attached thereto.

2. The pantry according to claim 1 wherein the swingable top wall has on overhanging skirt-like structure which overlaps a top of the front wall when the front wall is folded up into a transport configuration and the top wall is folded down to overlap the top edge of the front swingable wall.

3. The pantry according to claim 1 wherein the main module means has a first vertical partition wall having at a first side thereof said first and second compartment means and at an opposite side thereof said third and fourth compartment means.

4. The pantry according to claim 3 wherein the main module means first vertical partition wall has at the first side thereof a utensil drawer, a shelf defining a compartment for receiving the utensil drawer therebeneath, and a box storage region for narrow, tall boxes having a height greater than their width between the first partition wall and a side wall of the module and above the shelf covering the utensil drawer.

5. The pantry according to claim 3 wherein a second vertical partition wall is provided facing the opposite side of said first partition wall, a region between the second partition wall and a side wall of the module means forming additional compartment means below the serving plate shelf for receiving relatively low profile items whose width is approximately the same as a height thereof.

6. The pantry according to claim 1 wherein said means for selectively attaching and detaching comprises an extension of side walls of the catch-all module means which extend beyond said front wall thereof and which have slot means therein for engaging with protrusions mounted on side walls of the main module means.

7. The pantry according to claim 6 wherein the slot means comprises a substantially horizontal entrance portion and a substantially vertical retention portion.

8. The pantry according to claim 1 wherein the main module means and the catch-all module means comprise a plastic material.

9. The pantry according to claim 1 wherein the catch-all module means has opposite side walls with aperture means at respective upper portions thereof for carrying the catch-all module means separately from the main module means when it is detached therefrom.

10. The pantry according to claim 1 wherein first and second carrying handles are provided at a left side wall of the main module means when viewed from the front and third and fourth handle means are provided at the right side wall of the main module means when viewed from the front, the first and second and third and fourth handle means all being at a same height above a floor of the main module means, the first and third handle means being adjacent to and rearwardly of but at a same horizontal level as the second and fourth handle means, the first and third handle means being positioned for use when the catch-all module means is connected to the main module means, and the second and fourth handle means being positioned for use when the catch-all module means is detached.

11. The pantry according to claim 1 wherein first handle means are provided for use when the catch-all module means is attached to the main module means, and second handle means being provided on the main module means for use when the catch-all module means is detached.

12. A portable travel pantry, comprising:

a main module means for carrying and for arranging and segregating food items;

a plurality of separate compartment means for separately storing different types of food items;

said main module means having a swingable front wall, a swingable top wall, and a back wall opposite the front wall, the top wall and front wall being swingable between a transport configuration and a serving configuration;

a catch-all module means for receiving inside thereof relatively bulky food items, said catch-all module means having a front wall;

handle means at sides of the main module means for carrying the main module means; and means for selectively and detachably connecting the catch-all module means to the main module means such that said back wall of the main module means is directly adjacent to said front wall of the catch-all module means when the catch-all module means is attached to the main module means.

13. A portable travel pantry comprising;

module means for carrying and for arranging and segregating food items and items related to serving of food;

said module means having at least a first compartment means for separately storing the items relating to serving of the food and second compartment means for storing the food items;

said module means having a front wall, a top wall formed of a fixed back portion and swingable front portion, a back wall opposite the front wall, hinge means for swinging the swingable front portion from a transport configuration 180° back onto the top wall back portion in a serving configuration such that a top planar surface of the back portion is in abutment with and supports a top planar surface of the swingable portion, and the front wall also swingable between a transport configuration and a serving configuration;

handle means for carrying the module means; and a catch-all module means for receiving relatively bulky food items, said catch-all module means having a front wall, and means for selectively attaching and detaching the catch-all module means to the main module means such that said back wall of the main module means is directly adjacent to said front wall of the catch-all module means when the catch-all module means is attached to the main module means, and such that when the handle means on the main module means is employed to lift the main module means, the catch-all module means is also carried along with the main module means when it has been selectively attached thereto.

14. A portable travel pantry, comprising:

a main module means for carrying and for arranging and segregating food items;

a plurality of separate compartment means for separately storing different types of food items;

said main module means having a swingable front wall, a swingable top wall, and a back wall opposite the front wall, the top wall and front wall being swingable between a transport configuration and a serving configuration;

a catch-all module means having a front wall and an open top for receiving inside thereof relatively bulky food items;

handle means at sides of the main module means for carrying the main module means; and means for selectively and detachably connecting the catch-all module means to the main module means such that said back wall of the main module means is parallel and directly adjacent to said front wall of the catch-all module means when the catch-all module means is attached to the main module means, and such that when the handle means on the main module means is employed to lift the main module means, the catch-all module means is also carried along with the main module means when it has been selectively attached thereto.

* * * * *